US005748568A

United States Patent [19]

Harrison

[11] Patent Number: 5,748,568

[45] Date of Patent: May 5, 1998

[54] TIMEPIECE DISPLAY WHICH SUPERIMPOSES DIGITS AND GRAPHICS

[76] Inventor: Hal M. Harrison, 1556 NW 8th St., Boca Raton, Fla. 33486

[21] Appl. No.: 641,416

[22] Filed: May 1, 1996

[51] Int. Cl.[6] ..... G04C 19/00; G04B 19/00

[52] U.S. Cl. ..... 368/82; 368/223; 368/239

[58] Field of Search ..... 368/82–84, 223, 368/239–242

[56] References Cited

U.S. PATENT DOCUMENTS

| | | | |
|---|---|---|---|
| 4,121,415 | 10/1978 | Crutcher et al. | 368/240 |
| 4,130,987 | 12/1978 | Schickedanz | 368/282 |
| 4,242,747 | 12/1980 | Fahrenschon | 368/242 |
| 4,320,484 | 3/1982 | Burdet | 368/239 |
| 4,742,501 | 5/1988 | Coster | 368/82 |
| 4,752,919 | 6/1988 | Clark | 368/223 |
| 5,088,440 | 2/1992 | Keaney | 116/298 |
| 5,228,013 | 7/1993 | Bik | 368/223 |
| 5,526,327 | 6/1996 | Cordova, Jr. | 368/82 |

OTHER PUBLICATIONS

Flax art & design gift catalogue 1994, P.O. Box 7216, San Francisco, CA 94120 p. 3.

Casio Module No. 1289 User's Guide, printed in Japan, no date, pp. E4, E6, E15.

Alphabetical Guide to Motion Picture, by Eli Levitan, p. 369.

Film Editing Room Handbook, by Norman Hollyn, p. 15.

*Primary Examiner*—Vit W. Miska

[57] ABSTRACT

A watch or clock display shows hours as large digits and the minutes past the hour as the incremental filling of a familiar or regular figure. The digits and the partially filled figure are superimposed to make maximum use of the space available for the display.

At the new hour, and for a predetermined number of minutes thereafter (say five or 7.5), only the hour number is shown in the center of the display. Then the first of successive segments of the figure are displayed. As the hour progresses, the figure becomes more nearly filled by increments.

6 Claims, 5 Drawing Sheets

Fig. 4a
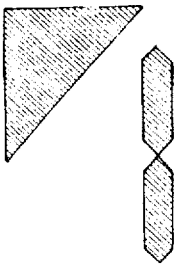
Fig. 4b
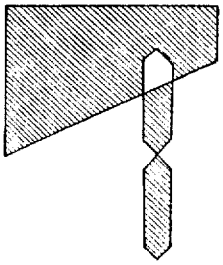
Fig. 4c
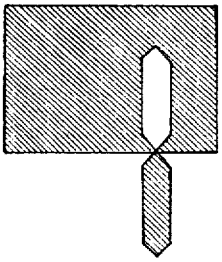
Fig. 4d
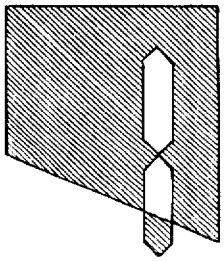
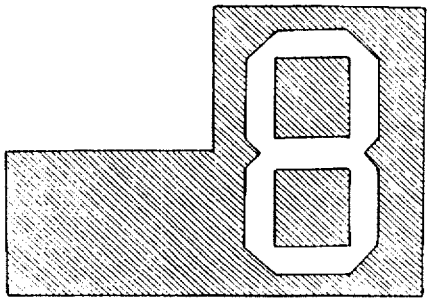
Fig. 4e
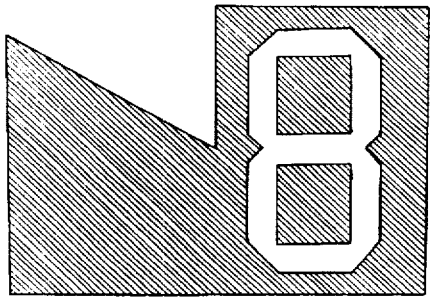
Fig. 4f
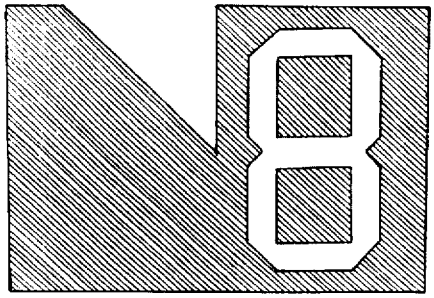
Fig. 4g
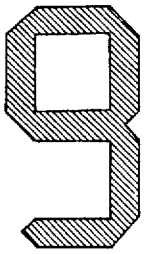
Fig. 4h

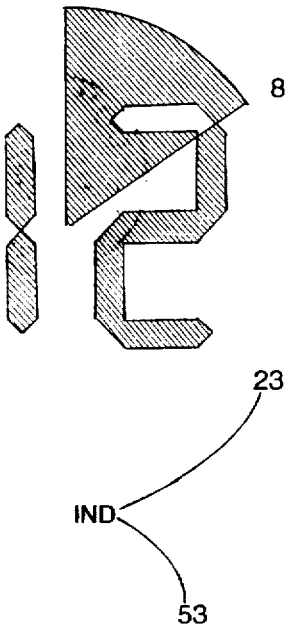
Fig. 5a
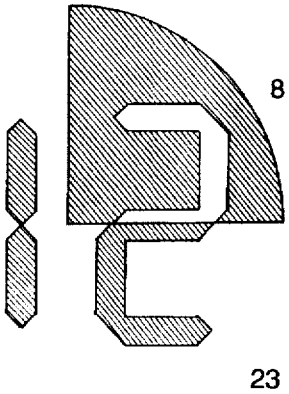
Fig. 5b
Fig. 5c
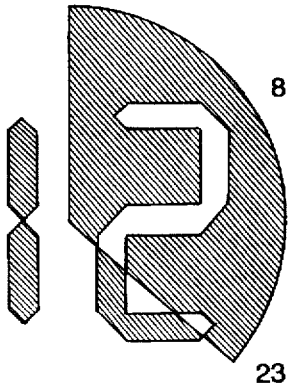
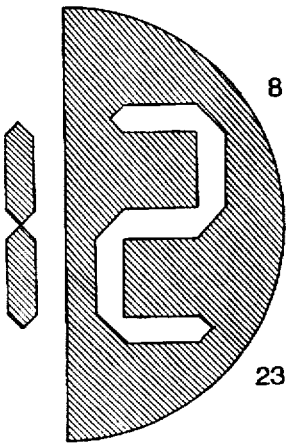
Fig. 5d

TIMEPIECE DISPLAY WHICH SUPERIMPOSES DIGITS AND GRAPHICS

BACKGROUND OF THE INVENTION

The object of this invention is to provide an easier way of telling the time.

We have timepieces which display revolving hands because historically clockmakers worked with motors and geared shafts. We learn to tell time fairly well on these analog faces, despite the requisite mental work of converting the angular positions of hands to numbers. Sometimes people even have to pause to decide which number the "little hand" is closer to.

More modern timepieces have digital displays because silicon devices keep time with integers; and their most efficient means of output is to 7-segment LED or LCD devices. Again we can tell time despite the requisite mental work of rounding numbers to the nearest multiple of five, fifteen, or whatever. But people rarely care whether it is ":31" or ":32" minutes past the hour.

Most new clock faces modify one of these two common displays with extra numbers, windows, colors, etc. Some are novelty displays, more for decoration than for telling time. A few redesign digital displays to resemble the hands of the traditional analog display. Some patents teach clocks with linear scales, perhaps because measuring time produces a point so easily marked on one or more number lines. But none reduces the requisite mental work described above; and many designs increase the mental work required to tell the time.

Prior art also shows the time at multiple display stations or sections, leaving the user to combine the two readings to get a single expression of the time. For example, in U.S. Pat. No. 4,752,919, issued Jun. 21, 1988, Lloyd Clark places hour digits to the left of a straight line of "discrete" or "binary" lights counting five-minute intervals of the hour. Enlarging the hour digits is good, but ascertaining the minutes requires some additional mental work. Either the user must (1) count from the first to the most recently activated light, or (2) he or she must find the end point of all the lights, on or off, and estimate the portion of that line which is activated (and it is a broken line at that). Using a straight line to represent minutes instead of an area also makes Clark's display unsuitable for a watch.

The present invention combines digital and graphic elements at a single location. The hour digits are easier to read because they are as large as the total size of the display, clock or watch, will allow. The minute indicator can be read in the same glance at the same location because it is an area superimposed in the same space as the digits. This display represents time to the degree of accuracy people generally use in their time expressions without the added complexity and inconvenience of unneeded accuracy.

SUMMARY OF THE INVENTION

This timepiece design improves the way we tell time by reducing the mental work required to convert the appearance of a display into an expression of the time. The display is achieved by using existing manfacturing techniques in a new layout. The usual display of digits is improved by superimposing a graphic upon the digits. Further objects and advantages will become apparent from a consideration of the following description.

Since the hour number is always wanted in any expression of time, this invention shows the hour as one or more large digits in the center of the display. The remainder of a time expression concerns the fraction of the current hour which has elapsed. We nearly always say, "A little before . . . " or "quarter past . . . ", or we round to the clock dial's historic numbers, 5, 10, . . . 55.

This display represents fractions of an hour as the fractional shading of a familiar or regular figure. When a greater fraction of the hour has passed, a greater fraction of the figure is shaded. The fractional shading is done in segments or divisions, each division representing the numerical increment to which the user would wish to round off the minutes-part of his or her expression of the time. For instance, FIG. 5(*d*) represents both "12:31" and "12:32". The display is the same because usually both times would be rounded to a single expression, such as "half-past 12" or "12:30".

Two features of the familiar or regular figure are important:

(1) The figure contains some area which may be partially shaded so that the actual "weight" or quantity of "color" present represents the desired fraction. In other words, the figure must have more than one dimension.

(2) The figure must be familiar or regular so that a partially shaded figures is easily completed in the user's mind and the ratio of the shaded versus unshaded areas is quickly perceived.

The hour number and the fraction of an hour together constitute the expression of a single time instant. These embodiments superimpose the number and the shading, making maximum use of the area available for the timepiece display and increasing readability over other timepiece faces of the same size. Because the numbers are larger than with a normal digital time piece and because the segments are of comprable size with the numbers, no fine detail is employed to show the time. This display is more easily read when the ambient light level is low or may be fitted with a less power-consuming back light.

Two models will be described, the 5–10–20 model which divides the hour into twelfths (5 minutes per division), and the 8–23 model which divides the hour into eighths (7.5 minutes per division). Both show quarters of an hour identically. The 5–10–20 model divides the quarter into three division (5, 10, 15, 20, etc.), showing the time more exactly. The 8–23 model divides the quarter into two segments (7.5, 15, 22.5, etc.), being read by some users a little more quickly and certainly. Of course models with different numbers of division per hour are readily made with these same techniques.

BRIEF DESCRIPTION OF THE DRAWINGS

FIG. 4 Examples of telling time, 5–10–20 model, showing the times: (a) 1:05, (b) 1:10, (c) 1:15, (d) 1:20, (e) 8:45, (f) 8:50, (g) 8:55, (h) 9:00.

FIG. 5 Examples of telling time, 8–23 model with indicia (IND) shown. The times are: (a) 12:07.5, (b) 12:15, (c) 12:22.5, (d) 12:30.

DESCRIPTION OF THE PREFERRED EMBODIMENTS

Terminology

Some electro-optical displays are called "7-segment" displays because any digit may be formed by lighting two or more of seven predetermined areas of the display. When referring to such electro-optical devices, I will call these areas "members" and the display a "7-member" display. I reserve the word "segment" for an area of any type display showing part of a familiar or regular figure. If all the "segments" were lit, the total figure would be visible. If all the "members" are lit, the digit 8 appears.

A "familiar or regular figure" is a simple form or symbol that is familiar to the user. For purposes of partial display, it is divided into two or more divisions. When only a few of the divisions are filled, the familiarity and regularity of the figure allow the user to easily complete the figure in his or her mind. This figure may be selected from the group consisting of circles, ellipses, polygons, stars, crosses, crescents, hearts, shields, airplanes, ships, cars, building, hour-glasses, flowers, humans, animals, cartoon figures, or cartoon heads, etc. My drawings use a rectangle and a circle as the familiar or regular figure.

At any instant my embodiments display one or two digits and zero or more segments surrounding and superimposed with the digit(s). I show the hours as Arabic numerals, but my invention could as easily employ Roman numerals, binary digits, Chinese characters, or some other means of counting to show the hour number. The following descriptions will show anyone skilled in LCD fabrication or in microprocessor programming how to make an example of this new display.

Two embodiments will be described:

(1) the layout of electro-optical hardware to produce a 5–10–20 display, and (2) an algorithm used to drive an all-points-addressable display to produce the 8–23 display.

Setting the Time

Though the time shown by this display is approximate, its setting must be exact. As the user is instructed:

> "You may find that setting your new timepiece 15–45 seconds fast is most suitable. The concept of showing time in increments falters when there is perceived slowness in the new increment appearing. Other clocks you will encounter during the day are usually a little fast or a little slow. The easiest way to compensate is to set yours 15–45 seconds fast. You can determine through use exactly how fast you want to set your new watch."

Of course some users may want to set the timepiece an entire division (5 or 7.5 minutes) fast.

Two or three common buttons or controls are provided on the case for setting this display to the nearest second. The "settings" control sequences the timepiece from run mode through the three setting modes of set-hour, set-minute, and set-second. When so switched, the two digits, which normally show the hour, now show minutes or seconds. The "increment" or "decrement" controls change the numbers as desired.

Figure 1:
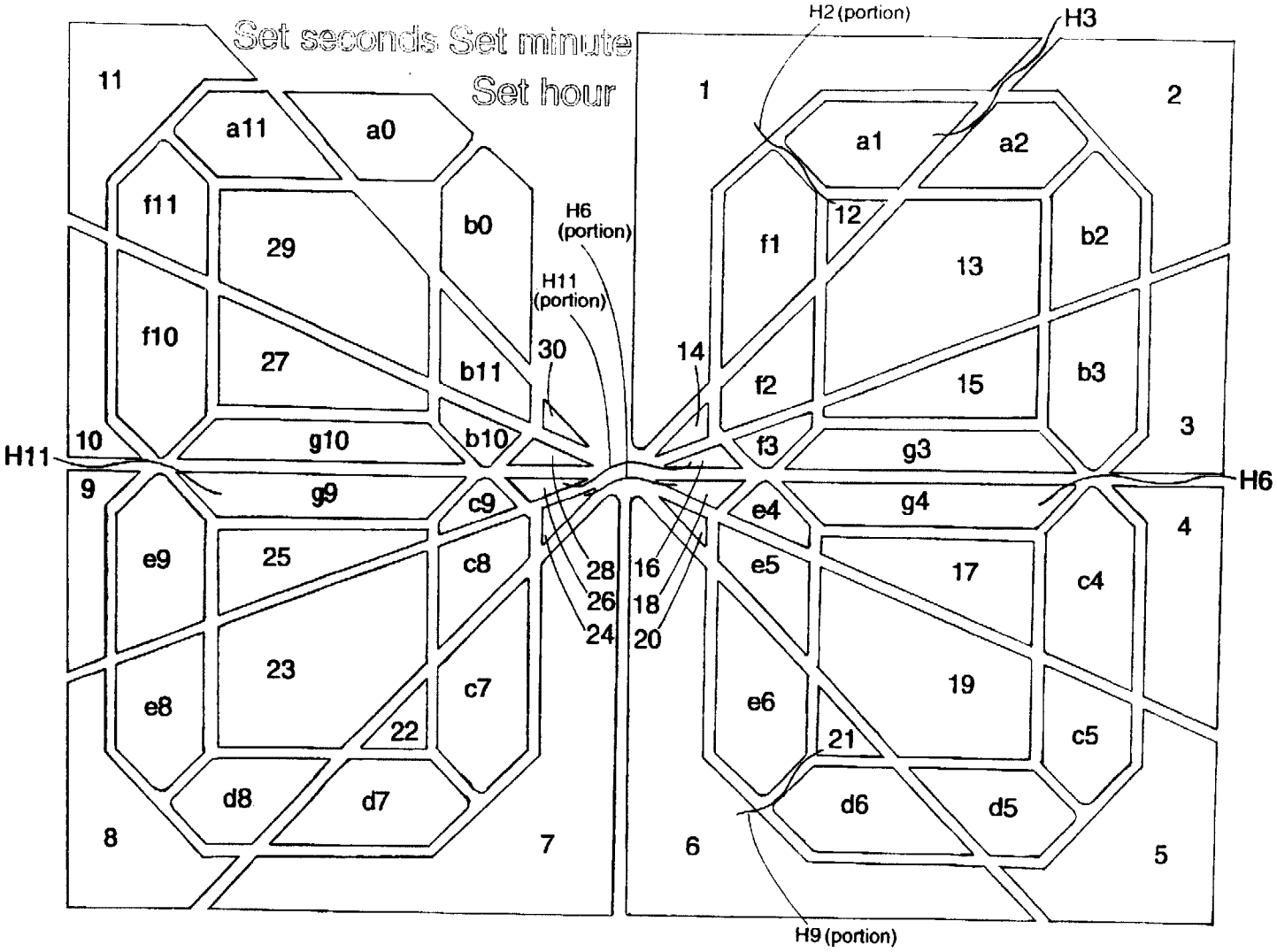
FIG. 1 Layout of electro-optical display for superimposing digits and segments, 5–10–20 model. H3, H6, and H11 are three runners requiring special comment. Portions of runners H2 and H9 also require special comment. The words "Set seconds . . . " etc. indicate setting modes.

While in one of the settings modes, the regular figure is not filled, and an indicator to identify the settings mode appears ("Set Seconds", etc. FIG. 1). The obvious order of setting modes is hour, minutes, then seconds. But one improvement is to repeat some modes in this order: hour, minutes, seconds, minutes, then hour. This eliminates some users' confusion about, "Was the watch running while I was setting it?" The clear indication of setting modes, whether by words as in FIG. 1 or by the traditional indicator under a word printed on the case, makes this improvement possible.

Any model of this timepiece may be fitted with an audio component such as a chime, piezo buzzer, or music-synthesis electronics. The timepiece can be set, at the user's option, to produce an audio signal when the number of divisions displayed changes.

ELECTRO-OPTICAL HARDWARE LAYOUT

When designing an electro-optical display incorporating this invention, the 5–10–20 model is the more difficult because it contains more members and segments. Therefore, that model is shown here. The 8–23 model may be constructed in the same way but is less complex because it uses fewer members and segments and therefore has fewer runners.

Transparent electrode patterns for the hour digits are coated on the transparent substrate in the common way, except for the number of members. Instead of seven, each digit contains 16 members, a0–g10 in FIG. 1. To form the regular figure of a rectangle, additional electrode patterns are coated in the areas labeled 1–30 in FIG. 1. The selective activation or distortion of these areas, along with the selective activation of the members forming the digits, creates the appearance of filled segments and digits being superimposed as shown in FIG. 4(*a*)–(*h*).

The segments numbered 1–11 in FIG. 1 also identify the eleven divisions into which the hour is divided in the 5–10–20 model. The segments labeled 12–30 identify additional electrodes, each of which is logically part of one of the first 11 divisions. For instance, whenever segment 1 is activated, then segment 12 must also be on. If segment 2 is on, then segments 13 and 14 must also switch on; and so forth until segments 29 and 30 follow segment 11.

To describe the members comprising the digits, I start with the standard nomenclature for 7-member LED devices where "a" through "f" identify 6 areas clockwise from the top, and "g" the center area. Subdivisions of the standard areas are further named with a number to show in which of the 11 divisions the member appears. That is, a1 names the portion of "a" lying in division 1 and a2 the portion in division 2. The two parts of "b" are NOT called b1 and b2, but rather b2 and b3 because they lie in divisions 2 and 3. Naming continues in the same way all around the face. Members a0 and b0 are the portions of the tens-position "a" and "b" which accompany no segment, the area between segments 11 and 1 never being filled.

Figure 2:
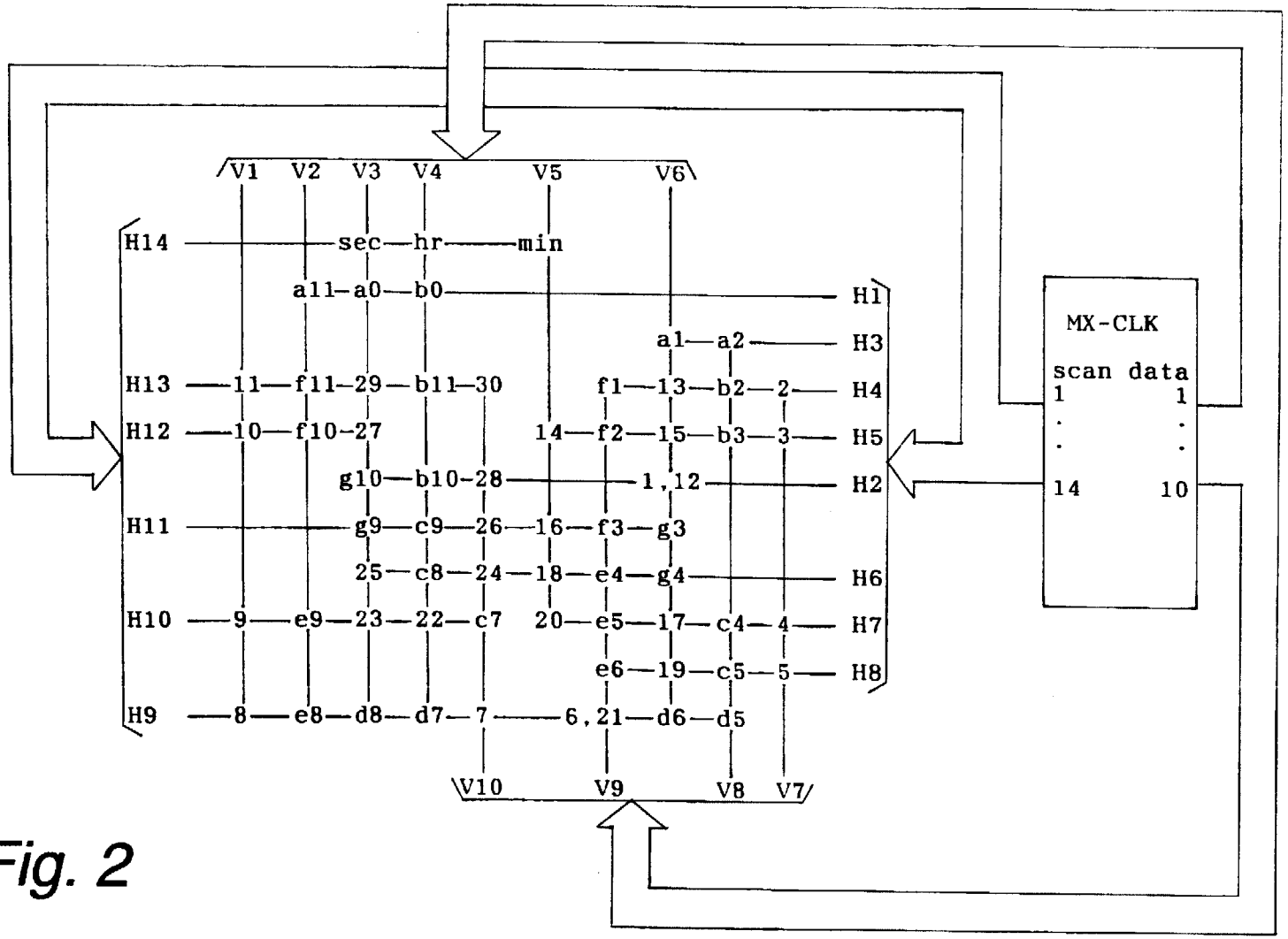
FIG. 2 Wiring diagram for electro-optical display of FIG. 1 showing all twenty-four runners.

The 62 segments and members in the display of FIG. 1 are driven by time-division multiplexing means from common digital time-keeping electronics (MX-CLK) as wired in FIG. 2. That is, a strobe signal is sequentially applied to the scan rows (H1–14), and data signals are applied to the vertical runners (V1–10). Activation of a single segment or member occurs when its data signal is "on" and its scan signal is high. Conversely, a segment or member not receiving both data and scan signals is "off". With two exceptions, runners are wired to the segments and members so as to isolate individual areas for individual control. The exceptions are segments 12 and 21 which are never activated independently. When H2 is strobed and V6 is on, both segment 1 and segment 12 activate, and strobe H9 and data V9 activate both 6 and 21, as shown in FIG. 2.

For example, to show any time between 1:05 and 1:10, members b2, b3, c4, and c5 and segments 1 and 12 are energized, as shown in FIG. 4(*a*). The multiplexer shown in in FIG. 2 accomplishes this with selective activation of certain runners. With V6 on, H2 is strobed; and with V8 on, H4, H5, H7, and H8 are strobed.

To show 12:30 (as in FIG. 5(*d*)), the members in FIG. 1 labeled b0, b11, b10, c9, c8, c7, segments 1–6, 12–21, and members f1, f2, f3, c4, and c5 must be on—27 total. The multiplexer of FIG. 2 achieves this by setting V4 on and strobing H1;

setting V4 and V6, with H2;

setting V6, V7, and V9, with H4;

setting V5, V6, V7, and V9 with H5;

setting V4 and V5 with H6;

setting V5, V6, V7, and V8 with H7;

setting V6, V7, and V8 with H8;

setting V9 with H9;

setting V10 with H10;

setting V4, V5, and V9 with H11; and finally V4 with H13.

This leaves members a1, a2, b2, b3, g3, g4, e4, e5, e6, d6, and d5 "off" so that the digit "2" appears superimposed on the fractionally shaded figure (as in FIG. 5(*d*)).

As in designing conventional 7-member LCD displays, attention must be paid to the exact physical distance between adjacent segments. This distance must be great enough to achieve electrical isolation, but near enough to simulate visual continuity.

In my display the distance between segments 1 and 2 must be great enough to allow passage of runner H3. Runner H6 divides segment 3 from 4 and member b3 from c4. The same is true for segments adjacent to the portions of H2 and H9 shown and for those next to H11. (These runners are shown as wavy lines so they will stand out on the drawing. On the substrate they are actually very straight to conserve space and not touch the unintended segments.) Therefore these distances are the minimum required between adjacent electrode areas; and the distances between other adjacent areas are increased somewhat to give the whole display an appearance of uniformity. Portions of runners H6 and H11 are shown at the center of the display. The segments of this embodiment appear to meet at a point in the center of the display, but the presence of these two runners requires tempering the pointed-ness and the proximity of segments 1, 6, and 7 at that location.

In its setting modes, this display lights no segments but only members. Runners V3, V4, V5 and H14, FIG. 2, are multiplexed with other members' runners to display the numbers and the appropriate mode indicator ("Set hour", "Set minute", or "Set seconds" in FIG. 1).

An additional run mode is possible with this same display in which hours are shown in Military time format, 0–23. However, in normal run mode (showing the time in non-Military format) only the b0, b11, b10 and c9, c8, c7 members of the left digit are used. The remaining members are only lit independently during one of the setting modes; this is, the nine members d7 through all usually follow the state of segments 7 through 11.

Obviously, additional information may be displayed (for instance am, pm, alarm indicators) by adding additional electrodes and adding more runners and connections to the external electronic circuitry. Indicia may be displayed in the same way, or shown on the containing case.

Since this display changes less frequently than a traditional digital timepiece, the rise time of the electro-optical elements (milliseconds required to switch from "off" to "on") is not as critical. This makes it possible to develop new types of displays that provide better appearance with lower power consumption. Areas to explore include (1) alternate formulas for the mixture of liquid crystal and less commonly used materials, (2) other techniques, such as electro-chronic displays (tungsten oxide for example), and (3) slower scan rates where more power is initially delivered to each segment which then requires less frequent refreshing.

ALGORITHM TO DRIVE AN ALL-POINTS-ADDRESSABLE DISPLAY

This timepiece may also be implemented using a microprocessor and a conventional, all-points-addressable electro-optical display (such as a clock face produced on a graphic computer screen). The pseudo-code given in Appendix A produces a display equivalent to the hardware implementation already described, except showing the 8–23 model. Appendix A references FIG. 3. Code for the 5–10–20 model may easily be extrapolated from this pseudo-code by adding more coordinates to define additional divisions (in the Radial-Lines-Table. Appendix A) and adding more conditions to the function which displays figure segments.

The program contains a main procedure which calls three subroutines. The main procedure continually queries the system for the current time. If multi-tasking were available, a timer interrupt handler could replace this polling. When an appropriate increment (not necessarily one minute) has passed, the main procedure calls subroutines to display different elements of the timepiece face. In a messaging operating system, these calls would be made under the processing of a Timer message.

One subroutine displays any indicia desired around the circumference of said figure (for instance, IND in FIG. 5.), another subroutine outlines the hour digits, and a third the partially filled familiar or regular figure. The actual code for some basic steps (for instance, clearing the screen, drawing and filling areas with color) will depend upon the basic functions provided by the supporting hardware. If not provided by the target system, they are easily written using commonly known algorithms.

Figure 3:
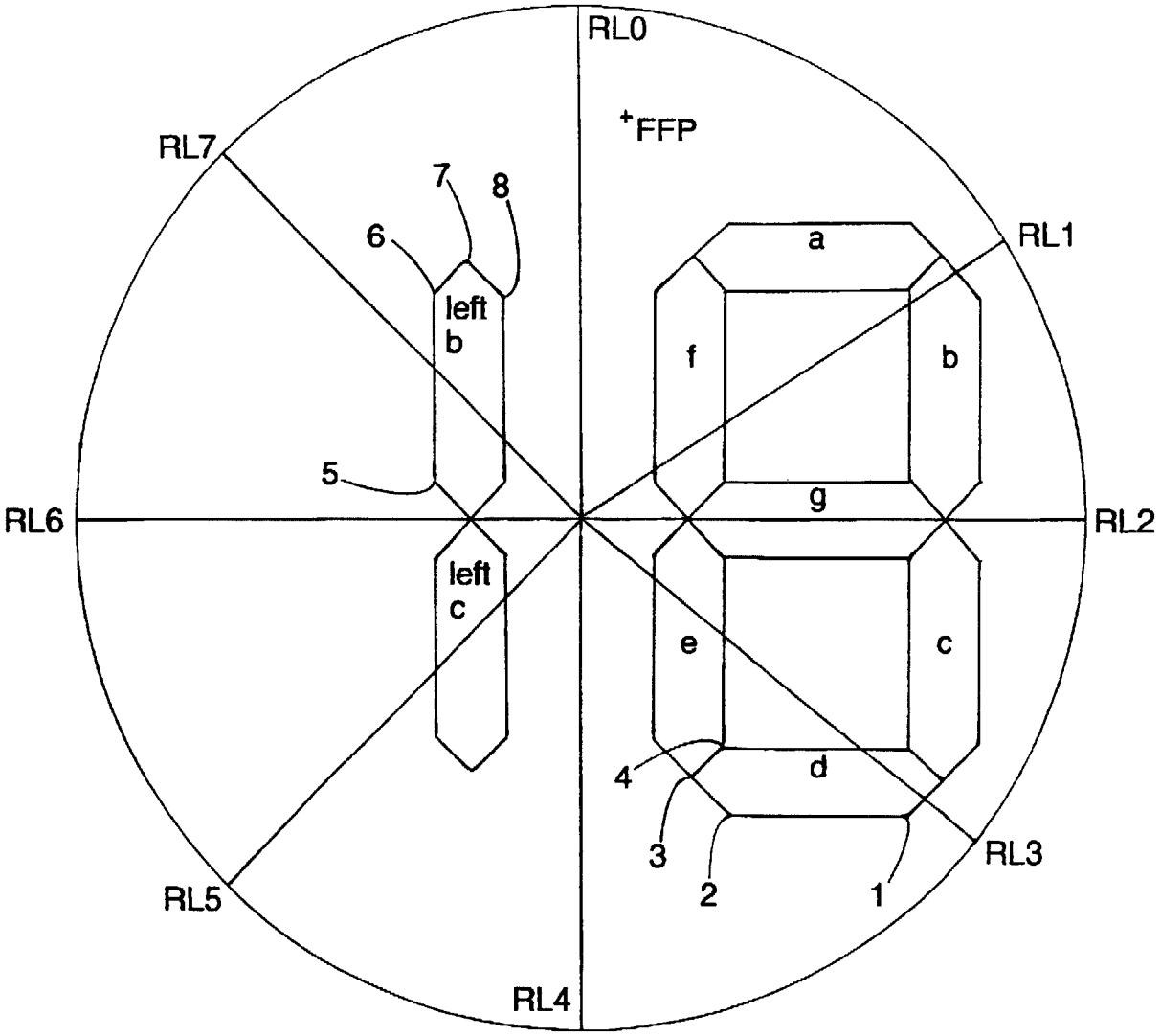
FIG. 3 Template for drawing superimposed digits and divisions on an all-points addressable graphic display, 8–23 model. RL0–RL7 are eight Radial Lines dividing the figure into eight increments.

In this embodiment, the portion of the regular figure to be filled is drawn with the minimum number of lines. That is, only two of the radial lines shown in FIG. 3 are actually drawn at any one time (RL0 and the RL line showing maximum advance clockwise). Any two adjacent members, if drawn, actually touch. Therefore, all the areas needing filling are discretely outlined. This is in contrast to FIG. 1 where all the lines shown are always present in the display. Also, where FIG. 1 has up to 30 segments for filling the figure, FIG. 3 usually has only one at any given time: the area bounded by RLO, the current radial line, the perimeter of the regular figure, and the outside edges of any members drawn. When certain members are all drawn, forming loops in the digits 6, 8, or 9, then those additional segments must be explicitly filled.

This implementation uses a common Fill function which, given any point inside an already drawn closed outline, fills that area with color up to the outline.

The subroutine "Display figure-segments" (see Appendix A) creates the impression of superimposition by choosing which discrete areas to fill. Consider the current radial line as the advancing edge of the minutes indicator. Behind the line, segments must be filled and members left empty. Segment(s) are filled starting from a first-fill-point (FFP, FIG. 3). Ahead of the line, segments are empty and members filled. Therefore, ahead of the line members are filled starting from the end of the member always ahead of any line which splits the member. In this way the current radial line always delimits the fill action in segments to the rear and members to the front, and the fill subroutine is not concerned with exactly which radial line is currently displayed.

The Map variable specifies which members are outlined and the variable Secs-past-hour specifies how advanced the current radial line is. Superimposition is key to the embodiment and the code for "Display figure-segments" is shown in detail for the 8–23 model.

When this device is dedicated to the timepiece, then setting is accomplished with common buttons or controlls as previously described. When in a setting mode, additional calls are made to draw any of the five additional members not shown in FIG. 3 for the left digit. If this device is also used for other processing, then a means of setting the system clock will already be provided.

I have described two embodiments of this display. Two others are immediately apparent; an electro-optical display of the 8–23 model, and an all-points addressable display of the 5–10–20 model. Other embodiments may be made with this same art using various light sources or light-modifying materials to form these same types of members and segments. Also I have illustrated the hour divided into eights and twelfths. A similar display could be made dividing the hour into as few parts as halves or thirds, or into as many parts as sixteenths, thirty-seconds, or some number in between. Additionally, I have already listed some of the variety of shapes the regular or familiar figure may take and point out here that for some embodiments a sub-area of the regular figure comprising its center may be left always unfilled.

In other embodiments, the hour digits may be shown in different characters (Roman numerals) as already mentioned. The hour could be shown in Military time format (numbers 0 to 23). Another way of distinguishing between a.m. and p.m. (or alternately daylight hours vs. night hours) is to reverse foreground and background colors for half the 24-hour period. For example, if the presence of color is taken to means the portion of the hour which has elaspsed (FIGS. 4 and 5) during daylight hours, then the reverse—regular figure begins filled, portion of the hour which has elapsed is cleared—could represent night time hours. In this case, the last segment would be operable. Therefore the scope of this invention should not be determined by the embodiments illustrated but by the following claims and their legal equivalents.

APPENDIX A

```
Main routine to display time
    Initialize a two-color pallet and set coordinate origin
        to point on screen where center of regular figure is
        desired.
    Get current hour, minute, and second from real time
        clock converting hours to the range 1–12. (Always
        normalize new time numbers however acquired.)
    Calculate Seconds-past-hour.
LOOP FOREVER
    IF run mode THEN
        CALL Display indicia around circumference
            of regular figure.
        CALL Display hour digits (argument: Current
            hour, return: Bit-map identifying
            segments drawn).
        Calculate Number of figure-Segments to
            display (Secs-past-hour /
            seconds-per-segment).
        CALL Display figure-segments (arguments:
            Secs-past-hour, Num-segs, Bit-map of
            members drawn)
```

APPENDIX A-continued

```
ELSE IF a settings mode THEN
    Display mode indicator ("Set hour . . .")
    CALL Display hour digits (argument: Current
        hour, Current minute, or Current
        second--depending on which settings mode,
        return: Bit-map of segments drawn).
    CALL Display figure-segments (arguments: 0,
        0, Bit-map)
END if
POLLING LOOP
        /* Remain inside this loop until */
        /* something occurs requiring a change */
        /* of the dispaly--the time or a */
        /* command from the user to change */
        /* settings mode or to increment or */
        /* decrement a number being set. */
    IF "set" button hit THEN
            Step Setings mode to next state
    END if
    Get Test hour, minute, second from real
      time clock.
        /* Test time is tested against Current
        /* time to see if display needs */
        /* changing. */
    Reset change and clock flags
    SWITCH on Settings-mode
    CASE run mode
            IF Secs-past-hour advanced to next
                division THEN /* change display */
                    Set change flag
            END if
    CASE set hours or minutes
            IF "+" or "–" button hit THEN
                    IF Test minute wraps to next
                        hour THEN
                                /* User is probably */
                                /* using a short */
                                /* cut between 55 */
                                /* and 5. */
                            Do not wrap hour, only
                                minutes
                    END if
                    Increment or decrement Test
                        hour or minute
                    Set change and clock flags
                                /* also set clock */
            END if
    CASE set seconds counting, first button
        press
            IF "+" or "–" button hit THEN
                    Frozen time = Test time
                    Increase or decrease Frozen
                        second by modulo amount to
                        required ×0 or ×5 number
                    Set Settings-mode for frozen
                        state
                    Curent time = Frozen time
                    Exit polling loop
            END if
    CASE set seconds frozen, subsequent button
        presses
            IF Frozen minute != Test minute THEN
                            /* Keep time at the minutes */
                            /* level even while seconds */
                            /* appear frozen. */
                    Advance Frozen time by one
                        minute
            END if
            IF "+" or "–" button hit THEN
                    Increase or decrease Frozen
                        second by multiples of five
                    IF Test seconds wraps to
                        another minute THEN
                                /* User is probably */
                                /* using a short */
                                /* cut between 55 */
                                /* and 5. */
                            Do not wrap minute, only
                                seconds
```

APPENDIX A-continued

```
                    END if
                    Curent time = Frozen time
                    Exit polling loop
            END if
        CASE "s" hit from set seconds frozen state
            Test time = Frozen time
            Set Settings-mode for seconds
                counting state
            Set change and clock flag
        END switch
        IF change flag THEN
            IF clock flag THEN
                    Set system clock from Test time
            END if
            Current time = Test time
                                /* what gets displayed */
            Exit polling loop
        END if
    END polling loop
    Clear the screen.
  END loop forever
END main routine.
DEFINE STORAGE: Radial-Lines-Table. An array of points, one
    entry for each division of the regular figure plus a
    starting entry (12 entries for the 11 divisions of the
    5-10-20 model, 8 entries for the 7 divisions of the
    8-23 model). (RL0–RL7 in FIG. 3) Each entry holds the
    coordinates of a point through which a line may be
    drawn to the origin (center of the regular figure).
    The collection of these radial lines defines the edges
    of the divisions of the regular figure.
SUBROUTINE: Display indicia around circumference of regular
  figure
    LOOP once for each possible figure division.
        SWITCH on the loop counter.
        Include the cases where indicia appear (cases 1,
            3, 5, and 7 are shown in FIG. 5)
                At each case, calculate location of
                    indicator from Radial-Lines-Table and
                    value for perimeter of figure.
                Draw the indicator.
        END switch
    END of loop
END display indicia subroutine
SUBROUTINE: Display hour digits (parameter: Number).
    /* This embodiment imitates character font of */
    /* 7-member LCD-s. */
    Reset Map = 0, a variable containing bit flags.
    Isolate low order digit of Number.
    Point to low order byte of Map
    WHILE another digit LOOP
        SWITCH on digit.
        At each case, for each member composing the digit,
                CALL Make vertical member, or
                CALL Make horizontal member, and
                Set appropriate bit in Map variable.
                For instance . . .
        CASE 2:
                CALL Make horizontal member with locations
                    for members "a", "g", and "d".
                CALL Make vertical member with locations
                    for members "b" and "e".
                Set bits in Map for "a", "b", "d", "e",
                    and "g".
        END of switch
        Isolate next digit of Number, point to next byte
            of Map, and bump member locations to next digit
            position.
    END loop
    RETURN Map variable.
END display hour subroutine
SUBROUTINE: Make horizontal member (parameter: Point)
    /* Static offsets from given point determining size
        and shape of the horizontal members. In this case
        (see FIG. 3) these offsets are Horizontal Length
        (distance from point 1 to point 2, FIG. 3), Horizontal
        Height (distance from point 2 to point 4), and
        Horizontal Triangle Length (distance from point 3 to
        a line joining points 2 and 4). */
```

APPENDIX A-continued

```
    Move to given Point.
    Draw line to first vertex (Point.x – Horizontal
        Triangle Length, Point.y – (Horizontal height / 2)).
    Draw line to other vertices using similar calculation.
        Finally,
    Draw line to Point.
END make horizontal member subroutine
SUBROUTINE: Make vertical member (parameter: Point)
    /* Static offsets from given point determining size
        and shape of the vertical members. In this case (see
        FIG. 3.) these offsets are Vertical Height (distance
        from point 5 to point 6, FIG. 3.), Vertical Width
        (distance from point 6 to point 8), and Vertical
        Triangle Height (distance from point 7 to a line
        between points 6 and 8). */
    Move to given Point.
    Draw line to first vertex (Point.x, Point.y – Vertical
        Height)).
    Draw line to other vertices using similar calculation.
        Finally,
    Draw line to Point.
END make horizontal member subroutine
SUBROUTINE: Display figure-segments (parameters:
  Secs-past-hour, Num-segs, Map)
    IF Secs-past-hour >= 450 THEN
                    /* at least 7.5 min has passed */
                /* Draw everything needed for X:07.5, or more.*/
            Draw outline portion of regular figure subtended
              by angle Radial-Line-Table[0] and
              Radial-Line-Table[Nun-segs].
            Fill portion of regular figure lying outside any
              members drawn starting from point FFP in FIG. 3.
            IF Map shows Upper Cavity drawn THEN
                    /* digits 8, 9 */
              Fill from point just inside intersection of
                members "a" and "f".
            END if
    END if
        /* Fill individual polygons to complete superim- */
        /* position, depending upon which of seven divi- */
        /* sions is being drawn. If the left "b" is drawn,*/
        /* at least its top portion is always filled. */
    IF Map shows left "b" member drawn THEN fill it from
        its top.
    IF Secs-past-hour < 900 THEN /* not yet 15 min */
                /* Fill the members which would be split by */
                /* the 7.5 min radial line from their */
                /* uncovered ends. */
            IF Map shows "a" member drawn THEN fill it from
              right end.
            IF Map shows "b" member drawn THEN fill it from
              bottom.
            IF Map shows "f" member drawn THEN fill it from
              bottom.
                    /* At X:00, the whole member, if drawn, */
                    /* is filled. While at X:07.5, only the */
                    /* uncovered portion, up to the radial */
                    /* line is filled. */
    END if
    IF Secs-past-hour < 1350 THEN /* not yet 22.5 min */
            Do the same for members "c" and "g".
    END if
    IF Secs-past-hour < 1800 THEN /* not yet 30 min */
            Do the same for members "d" and "e".
    END if
    IF Secs-past-hour < 2700 THEN /* not yet 45 min */
            Do the same for left "c" member.
    END if
    IF Secs-past-hour >= 1350 THEN /* 22.5 min or past */
            IF Map shows Lower Cavity drawn THEN
                    /* digits 6 or 8 */
                Fill it from just inside intersection of
                  "g" and "c".
            END if
    END if
END display figure-segment subroutine
```

I claim:

1. A method for displaying the time on a timepiece display as one or more digits superimposed with a familiar or regular figure divided into a plurality of divisions, where the total area of said figure represents the 60 minutes of an hour and where one or more of said divisions appears displayed in part or all of the same area used by one or more of said digits, comprising the steps of:

(a) shading predetermined areas of the display to show said digits to represent the hour of the time;

(b) shading zero or more of said divisions so that the area of said figure apparently shaded at any one time represents the approximate fraction of the hour which has passed since the hour began; and (c) filling said display for showing said digits as discrete from any parts of one or more shaded divisions with which they superimpose so that said digits are easily read.

2. A timepiece display for showing the time as one or more digits divided into a plurality of members, said digits apparently superimposed with a familiar or regular figure divided into a plurality of segments, where the total area of said figure represents the 60 minutes of an hour and where one or more of said segments appears to superimpose with one or more of said members, comprising:

(a) an electro-optical display of one or more of said members to show one or more of said digits to represent the hour;

(b) an electro-optical display of zero or more of said segments so that the fraction of said figure apparently displayed represents the approximate fraction of the hour which has passed; and (c) controlling means for selectively activating the superimposing members and segments so that said digits are discretely displayed and easily read.

3. A method for displaying the time on a timepiece as one or more digits in conjunction with a familiar or regular figure, the total area of which represents the 60 minutes of an hour, comprising the steps of:

(a) displaying said digits to represent the hour of the time;

(b) displaying zero or more filled divisions of said figure so that the area filled at any one time provides an instantly readable representation of the approximate fraction of the hour which has passed since the hour began; and (c) displaying one or more indicia positioned around said figure so as to indicate the number of said divisions which may appear in said figure.

4. The method of claim 3 wherein the indicia indicate the approximate number of minutes the filled segments represent.

5. A timepiece display for showing the time as one or more digits representing the hour in conjunction with a familiar or regular figure, the total area of the figure representing the 60 minutes of the hour, comprising:

(a) an electro-optical display of one or more digits to represent the hour;

(b) an electro-optical display of segments which together constitute divisions of said figure, zero or more of said segments being filled at any one time so that the area filled represents the approximate fraction of the hour which has passed; and (c) including one or more indicia positioned around said figure to indicate the number of said divisions which may appear in said figure.

6. The timepiece display of claim 5 wherein said indicia indicate the approximate number of minutes the filled divisions represent.

* * * * *